US010138574B2

(12) United States Patent
Faridi Majidi et al.

(10) Patent No.: US 10,138,574 B2
(45) Date of Patent: Nov. 27, 2018

(54) BLOWING-ASSISTED ELECTROSPINNING

(71) Applicants: Reza Faridi Majidi, Tehran (IR); Nader Naderi, Tehran (IR); Ali Gheibi, Tehran (IR)

(72) Inventors: Reza Faridi Majidi, Tehran (IR); Nader Naderi, Tehran (IR); Ali Gheibi, Tehran (IR)

(73) Assignee: FANAVARAN NANO-MEGHYAS COMPANY (LTD), Tehran (IR)

( * ) Notice: Subject to any disclaimer, the term of this patent is extended or adjusted under 35 U.S.C. 154(b) by 0 days.

(21) Appl. No.: 15/712,125

(22) Filed: Sep. 21, 2017

(65) Prior Publication Data

US 2018/0010263 A1 Jan. 11, 2018

Related U.S. Application Data

(60) Provisional application No. 62/408,840, filed on Oct. 17, 2016.

(51) Int. Cl.

| | |
|---|---|
| ***D01D 7/00*** | (2006.01) |
| ***D01D 5/00*** | (2006.01) |
| ***D01D 5/14*** | (2006.01) |

(52) U.S. Cl.

CPC ..... *D01D 5/0069* (2013.01); *D01D 5/0038* (2013.01); *D01D 5/0092* (2013.01); *D01D 5/14* (2013.01)

(58) Field of Classification Search

CPC .... D01D 5/003; D01D 5/0038; D01D 5/0046; D01D 5/0069; D01D 5/0076; D01D 5/14; D01D 7/00

(Continued)

(56) References Cited

U.S. PATENT DOCUMENTS 7,662,332 B2 2/2010 Chu et al.
7,934,917 B2 5/2011 Chu et al.

(Continued)

OTHER PUBLICATIONS

Jianxin He, Mass Preparation of Nanofibers by High Pressure Air-Jet Split Electrospinning: Effect of Electric Field, journal of polymer science, May 13, 2014, DOI: 10.1002/polb.23519.

(Continued)

*Primary Examiner* — Leo B Tentoni
(74) *Attorney, Agent, or Firm* — NovoTechIP International PLLC

(57) ABSTRACT

A method and an apparatus for fabricating nanofibrous articles is disclosed. The method may include providing a double-walled nozzle with an inner tube coaxially disposed within an outer tube. In addition, the double-walled nozzle is secured in front of a collector and an electrical field is applied between a tip of the double-walled nozzle and the collector. The method further includes preparing a spinning solution by dissolving a polymer in a solvent, mixing a vapor stream of the solvent with a stream of a pressurized gas with a predetermined ratio to obtain a pressurized solvent/gas stream feeding the spinning solution through the inner tube of the double-walled nozzle, and concurrently feeding the pressurized solvent/gas stream through the outer tube of the double-walled nozzle. The spinning solution and the pressurized solvent/gas stream may concurrently be discharged from the double-walled nozzle and drawn toward the collector being collected as nanofibrous articles on the collector.

11 Claims, 9 Drawing Sheets

(58) Field of Classification Search
USPC ..... 264/211.12, 211.14, 465, 484, 555
See application file for complete search history.

(56) References Cited

U.S. PATENT DOCUMENTS

| | | | | |
|---|---|---|---|---|
| 8,697,587 | B2 | 4/2014 | Arora et al. | |
| 9,220,998 | B2 | 12/2015 | Seo et al. | |
| 9,279,203 | B2 | 3/2016 | Kim et al. | |
| 2005/0067732 | A1* | 3/2005 | Kim | D01D 5/0038 264/172.19 |
| 2006/0138711 | A1* | 6/2006 | Bryner | D01D 5/0069 264/465 |
| 2007/0018361 | A1* | 1/2007 | Xu | D01D 5/0038 264/465 |
| 2008/0314010 | A1* | 12/2008 | Smithies | D01D 5/0084 55/498 |

OTHER PUBLICATIONS

Jani Holopainen Rapid production of bioactive hydroxyapatite fibers via electroblowing, Journal of the European Ceramic Society, May 6, 2016, vol. 36, pp. 3219-3224.

In Chul Um, Electro-Spinning and Electro-Blowing of Hyaluronic Acid, Journal of Biomacromolecules, Feb. 25, 2004, vol. 5, pp. 1428-1436.

Xupin Zhuang, Preparation of Polyacrylonitrile Nanofibers by Solution Blowing Process, Journal of Engineered Fibers and Fabrics, 2013, vol. 8, Issue 1, pp. 88-93.

Yasar Emre Kiyak, Nanofiber Production Methods, Electronic Journal of Textile Technologies, 2014, vol. 8, Issue 3,pp. 49-60.

* cited by examiner

BLOWING-ASSISTED ELECTROSPINNING

CROSS-REFERENCE TO RELATED APPLICATION

This application claims the benefit of priority from U.S. Provisional Patent Application Ser. No. 62/408,840, filed on Oct. 17, 2016 and entitled "Blown Electrospinning System," which is incorporated herein by reference in its entirety.

SPONSORSHIP STATEMENT

This application has been sponsored by Iran Patent Center, which does not have any rights in this application.

TECHNICAL FIELD

The present disclosure generally relates to electrospinning, and particularly to blowing-assisted electrospinning.

BACKGROUND

Electrospinning is a fiber production method that uses electric force to draw charged threads of polymer solutions or polymer melts. The diameters of these threads are generally in the order of some hundred nanometers. When an external electrostatic field is applied to a conductive fluid, for example a spinning solution, a suspended conical droplet, which is called Taylor cone, is formed. In electrospinning, a spinning solution is pumped from the tip of a nozzle and exposed to the electrostatic field, thereby forming a Taylor cone.

Electrospinning occurs when the electrostatic field is strong enough to overcome the surface tension of the liquid. The liquid droplet then becomes unstable and a tiny jet is ejected from the surface of the droplet. The ejected jet may be absorbed by a collector as a result of the electrostatic field that is provided by a power supply between the nozzle tip and the collector and is applied to spinning solution droplets. As the tiny jet reaches the collector, an interconnected web of fine sub-micron size fibers are collected on the collector.

Electrospinning has many industrial and medical applications. For example, electrospinning is used in producing biological membranes, such as substrates for immobilized enzymes and catalyst systems. As another example, electrospinning is used in the production of wound dressing materials, artificial blood vessels, aerosol filters, and clothing membranes for protection against environmental elements and battlefield threats. Electrospinning, in comparison with other methods for producing nanofibers, can be relatively more cost effective and feasible. However, electrospinning has also been associated with some challenges, such as low production speed, lower production throughput for smaller fiber sizes, and fouling of the nozzle, that may hinder the use of the electrospinning method for the mass production of nanofibers for laboratory and industrial applications. Therefore, there is a need in the art for electrospinning methods in which nano-sized fibers are fabricated with a higher throughput rate and a lower amount of fouling.

SUMMARY

In one general aspect, the present disclosure is directed to a method for fabricating nanofibrous articles. The method includes preparing a spinning solution by dissolving a polymer in a solvent, mixing a vapor stream of the solvent with a stream of a pressurized gas at a predetermined ratio to obtain a pressurized solvent/gas stream, and feeding the spinning solution through an inner tube of a double-walled nozzle. Furthermore, the method includes concurrently feeding the pressurized solvent/gas stream through an outer tube of the double-walled nozzle, where the inner tube is disposed coaxially within the outer tube. In addition, the method includes applying an electrical field between a tip of the double-walled nozzle and a collector, where the double-walled nozzle is secured in front of the collector, discharging the spinning solution and the pressurized solvent/gas stream concurrently from the double-walled nozzle, and producing nanofibrous articles on the collector.

The above general aspect may include one or more of the following features. In one example, the inner tube of the double-walled nozzle extends from a tip of the outer tube of the double-walled nozzle by a distance in the range of −10 to 10 mm. In another example, there is an air gap with a width ranging between 0.1 to 10 mm between the outer tube and the inner tube. In some cases, the electrical field includes a potential difference ranging between 10 and 100 kV. Furthermore, in one implementation, the polymer is selected from the group consisting of polyimide, Polyamide 6(PA6) and 6,6(PA6,6), hyaluronic acid (HA), polyaramide, polyacrylonitrile (PAN), polyethylene terephthalate (PET), polyaniline (PANI), polyethylene oxide(PEO), styrene butadiene rubber (SBR), polystyrene (PS), polyvinyl chloride (PVC), polyvinyl alcohol (PVA), polyvinylidene fluoride (PVDF), poly(lactic acid) (PLA), polyurethanes(PU), polysiloxanes or silicones, polyvinyl pyrrolidone (PVP), polycaprolactones, poly(methyl methacrylate) (PMMA), polyacrylamide (PAM), polyglycolides (PGA), poly(lactide-co-glycolides) (PLGA), polylactides, poly(acrylic acid), polybutene, polysulfide, cyclic polyolefins, and combinations thereof. The solvent can be selected from the group consisting of formic acid, N-dimethylformamide (DMF), water, chloroform, Dimethylacetamide (DMAc), Ethanol, Tetrahydrofuran(THF), Acetone, 2-Propanol, acetic acid, and combinations thereof. In another example, the polymer has a concentration ranging between 5% w/v and 40% w/v in the solvent. In some implementations, the stream of mixed solvent vapor and pressurized gas can have a pressure ranging between 100 and 2000 mbar. In one example, the spinning solution is discharged from the double-walled nozzle at a rate between 10 ml/hour and 100 ml/hour. In another example, the method can also include rotating the nozzle such that the nozzle is oriented toward the collector.

In another general aspect, the present disclosure is directed to an apparatus for fabricating nanofibrous articles. The apparatus includes at least a first double-walled nozzle, the first double-walled nozzle including an inner tube coaxially disposed within an outer tube, and a collector configured to receive nanofibers. In addition, the apparatus includes a power supply configured to produce an electrical field between a tip of the nozzle and the collector.

The above general aspect may include one or more of the following features. The inner tube can include an extended tip that extends distally outward from a tip of the outer tube in some cases. In another example, the inner tube is in fluid communication with a first injection line through which a spinning solution consisting of a polymer melt or a polymer solution is injected. Furthermore, in some implementations, the outer tube is in fluid communication with a second injection line through which a mixture of a stream of solvent vapor and a stream of a pressurized gas are injected. In some other implementations, the polymer is selected from the group consisting of polyimide, Polyamide 6 and 6,6, hyaluronic acid (HA), polyaramide, polyacrylonitrile (PAN), polyethylene terephthalate (PET), polyaniline (PANI), polyethylene oxide(PEO), styrene butadiene rubber (SBR), polystyrene (PS), polyvinyl chloride (PVC), polyvinyl alcohol (PVA), polyvinylidene fluoride (PVDF), poly (lactic acid) (PLA), polyurethanes(PU), polysiloxanes or silicones, polyvinyl pyrrolidone (PVP), polycaprolactones, poly(methyl methacrylate) (PMMA), polyacrylamide (PAM), polyglycolides (PGA), poly(lactide-co-glycolides) (PLGA), polylactides, poly(acrylic acid), polybutene, polysulfide, cyclic polyolefins, and combinations thereof. In one example, the apparatus further includes a nozzle holder, where the first double-walled nozzle is mounted on the nozzle holder, and the nozzle holder is configured to permit rotation of the first double-walled nozzle with respect to the collector. In another example, the apparatus also includes a compressed gas generating system configured to supply a compressed gas, and a solvent vapor generating system configured to preserve and heat a solvent. In some cases, the compressed gas generating system is in fluid communication with the solvent vapor generating system. Furthermore, the apparatus can include a pressure adjustment system configured to regulate a pressure of a solvent/gas stream produced by the solvent vapor generating system and a solution injection system configured to inject a spinning solution through the first double-walled nozzle. In addition, in one implementation, the apparatus further includes a second double-walled nozzle.

Other systems, methods, features and advantages of the implementations will be, or will become, apparent to one of ordinary skill in the art upon examination of the following figures and detailed description. It is intended that all such additional systems, methods, features and advantages be included within this description and this summary, be within the scope of the implementations, and be protected by the following claims.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings. The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be readily apparent to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

As will be discussed herein, systems and methods directed to fabricating nanofibrous articles from polymer solutions or melts by a high throughput blowing-assisted electrospinning process are disclosed. The systems and methods may include the application of two external electrical and mechanical forces to achieve a relatively high throughput during the spinning process. In electrospinning processes, the external electrical force is provided by applying an electrostatic field between a nozzle tip and a collector. However, in the blowing-assisted electrospinning process that will be described below, in addition to the external electrical force, a stream of a mixture of a gas and a solvent vapor provides the external mechanical force that may assist in shearing and dragging the fluid jet stream. The blowing-assisted electrospinning process provides significant benefits, including but not limited to consistent and high throughput production of smaller fiber sizes and a reduction in fouling amount at the nozzle tip.

Figure 1:
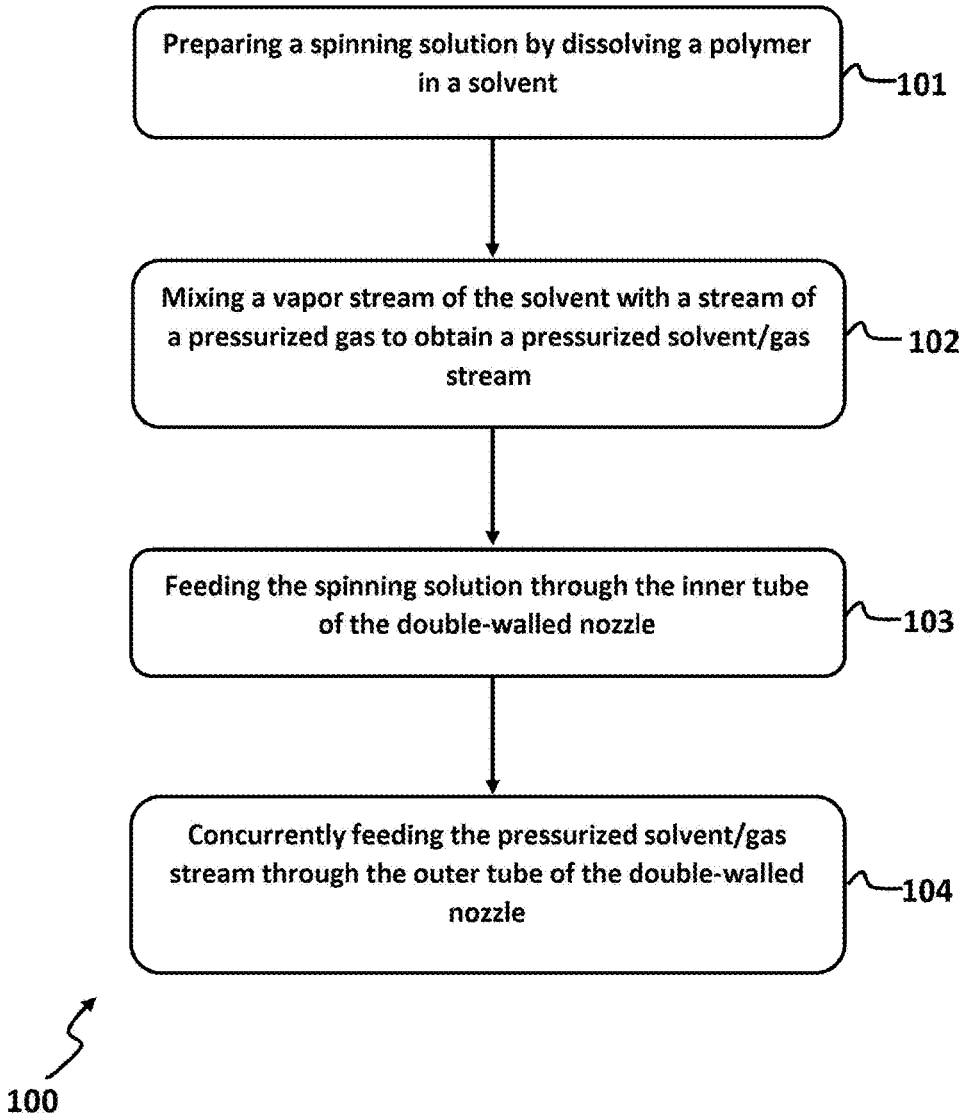
FIG. 1 illustrates an implementation of a method for fabricating nanofibrous articles from either polymer melts or polymer solutions.

Referring now to FIG. 1, a method 100 for fabricating nanofibrous articles from polymer melts or polymer solutions is illustrated in a flow chart. In some implementations, the method 100 may utilize an apparatus that includes a double-walled nozzle that may be secured in front of a collector, where an electrical field is applied between a tip of the double-walled nozzle and the collector. In one implementation, the double-walled nozzle may include an inner tube coaxially disposed inside an outer tube.

As shown in FIG. 1, the method 100 includes a first step 101 of preparing a spinning solution by dissolving a polymer in a solvent, and a second step 102 of mixing a vapor stream of the solvent with a stream of a pressurized gas to obtain a pressurized solvent/gas stream. Furthermore, the method 100 includes a third step 103 of feeding the spinning solution through the inner tube of the double-walled nozzle, and a fourth step 104 of concurrently feeding the pressurized solvent/gas stream through the outer tube of the double-walled nozzle. Concurrent feeding of the pressurized solvent/gas stream through the outer tube of the double-walled nozzle can provide a mechanical force that assists the external electrical force in shearing and dragging the fluid jet stream. Furthermore, the solvent that is mixed with compressed or pressurized gas may help to minimize polymer fouling at the nozzle tip.

Figure 2:
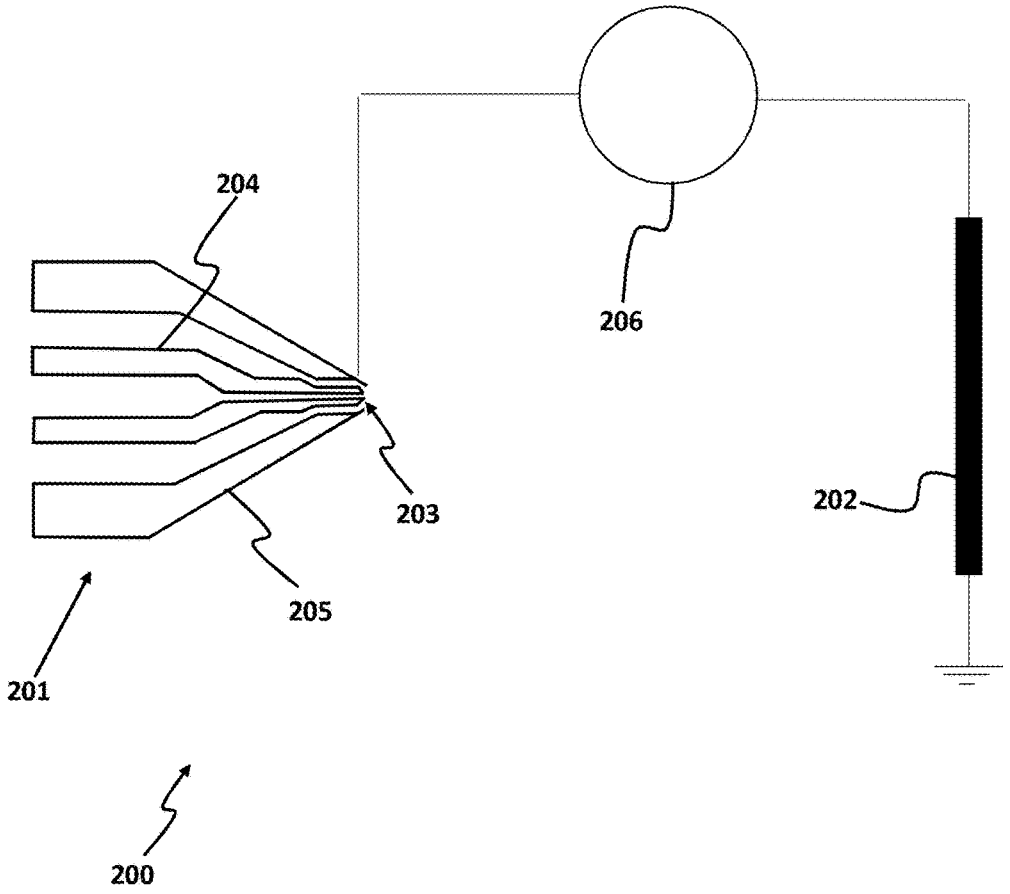
FIG. 2 illustrates a schematic design of an implementation of a nanofiber fabricating apparatus.

In order to provide more details regarding the system, FIG. 2 shows a schematic representation of a blowing-assisted electrospinning system 200 that may be configured for use with method 100 of FIG. 1. In FIG. 2, the blowing-assisted electrospinning system 200 includes a nozzle 201 and a collector 202. In addition, it can be understood that an electrical field is applied between a tip 203 of the nozzle 201 and the collector 202. A power supply 206 may be utilized to apply the electrical field.

In different implementations, the nozzle 201 may be a double-walled nozzle that may include an inner tube 204 that is coaxially disposed inside or within an outer tube 205. According to one implementation, the inner tube 204 of the nozzle 201 may be in fluid communication with a first injection line through which a spinning solution, such as a polymer melt or a polymer solution, may be injected. As an example, the injected polymer solution may be a solution of a polymer in a solvent with a concentration of approximately between 5% and 40% that may be fed through the inner tube 204 of the nozzle 201 at a rate of approximately 10 to 100 ml/hour.

Furthermore, in some implementations, the outer tube 205 of the nozzle 201 may be in fluid communication with a second injection line through which a mixture of a stream of the solvent vapor and a stream of a pressurized gas may be injected. The stream of the solvent vapor may be mixed with the stream of the pressurized gas with a predetermined ratio to obtain a pressurized solvent/gas stream. In one example, the pressurized solvent/gas stream may have a pressure in a range of about 100 to 2000 mbar.

In different implementations, a wide range of polymers may be used to prepare the spinning solution. For example, polyimide, Polyamide 6 and 6,6, hyaluronic acid (HA), polyaramide, polyacrylonitrile (PAN), polyethylene terephthalate (PET), polyaniline (PANI), polyethylene oxide (PEO), styrene butadiene rubber (SBR), polystyrene (PS), polyvinyl chloride (PVC), polyvinyl alcohol (PVA), polyvinylidene fluoride (PVDF), poly(lactic acid) (PLA), polyurethanes(PU), polysiloxanes or silicones, polyvinyl pyrrolidone (PVP), polycaprolactones, poly(methyl methacrylate) (PMMA), polyacrylamide (PAM), polyglycolides (PGA), poly(lactide-co-glycolides) (PLGA), polylactides, poly (acrylic acid), polybutene, polysulfide, cyclic polyolefins, or combinations thereof.

Furthermore, in some implementations, a wide range of liquids may be used as the solvent. For example formic acid, N-dimethylformamide (DMF), water, chloroform, Dimethylacetamide (DMAc), Ethanol, Tetrahydrofuran(THF), Acetone, 2-Propanol, acetic acid, or combinations thereof. As an example, the solvent may have a concentration in a range of 5% to 40% (wt), a viscosity in a range of 100 to 100000 cP, a surface tension in a range of 20 to 75 mN/m, a conductivity in a range of 1 to 30 mS/cm, and/or a dielectric constant in a range of 15 to 90.

Referring again to FIG. 2, in one implementation, the spinning solution may be discharged from the inner tube 204 and the pressurized solvent/gas stream may be concurrently discharged from the outer tube 205. As the spinning solution and the pressurized solvent/gas stream are discharged from the nozzle tip 203, a plurality of jets are formed and pulled toward the collector 202 in response to a combination of an electrical force exerted by the electrical field and a mechanical force exerted by the pressurized solvent/gas stream. The plurality of jets are then collected as nanofibers on the collector 202. In some implementations, the collected nanofibers may be in a form of a web, though in some other cases the nanofibers may form a mat or other relatively cohesive structure.

With further reference to FIG. 2, according to one implementation, the nozzle 201 may be disposed and oriented with respect to the collector 202, such that nozzle 201 is in front of the collector 202. Thus, in some implementations, the force owing to the pressurized solvent/gas stream and the force owing to electric field are in the substantially same direction and the discharged spinning solution stream from nozzle tip 203 is jetted directly toward the collector 202. Alternatively, according to another implementation, the nozzle 201 may be disposed and oriented with respect to the collector 202, such that the force owing to the pressurized solvent/gas stream and the force owing to electric field are in different directions. Thus, the discharged spinning solution stream from the nozzle tip 203 is jetted indirectly toward the collector 202.

In addition, according to some implementations, the collector 202 may include different shapes and various sizes, and may be constructed from various conductive materials. For example, in one implementation, the collector 202 may include a cylindrical shape and may further be configured to rotate about its longitudinal axis to collect nanofibers as a web. The absorption of nanofibers by the collector 202 is due to the electric field which is generated by the power supply 206 connected to nozzle tip 203 and the collector 202. In one example, one of the electrodes of the power supply 206 may be connected to the nozzle tip 203 and the other electrode of the power supply 206 may be connected to the collector 202. In one implementation, the positive electrode of the power supply 206 may be connected to the nozzle tip 203 and the negative electrode of the power supply 206 may be connected to the collector 202.

Figure 3:
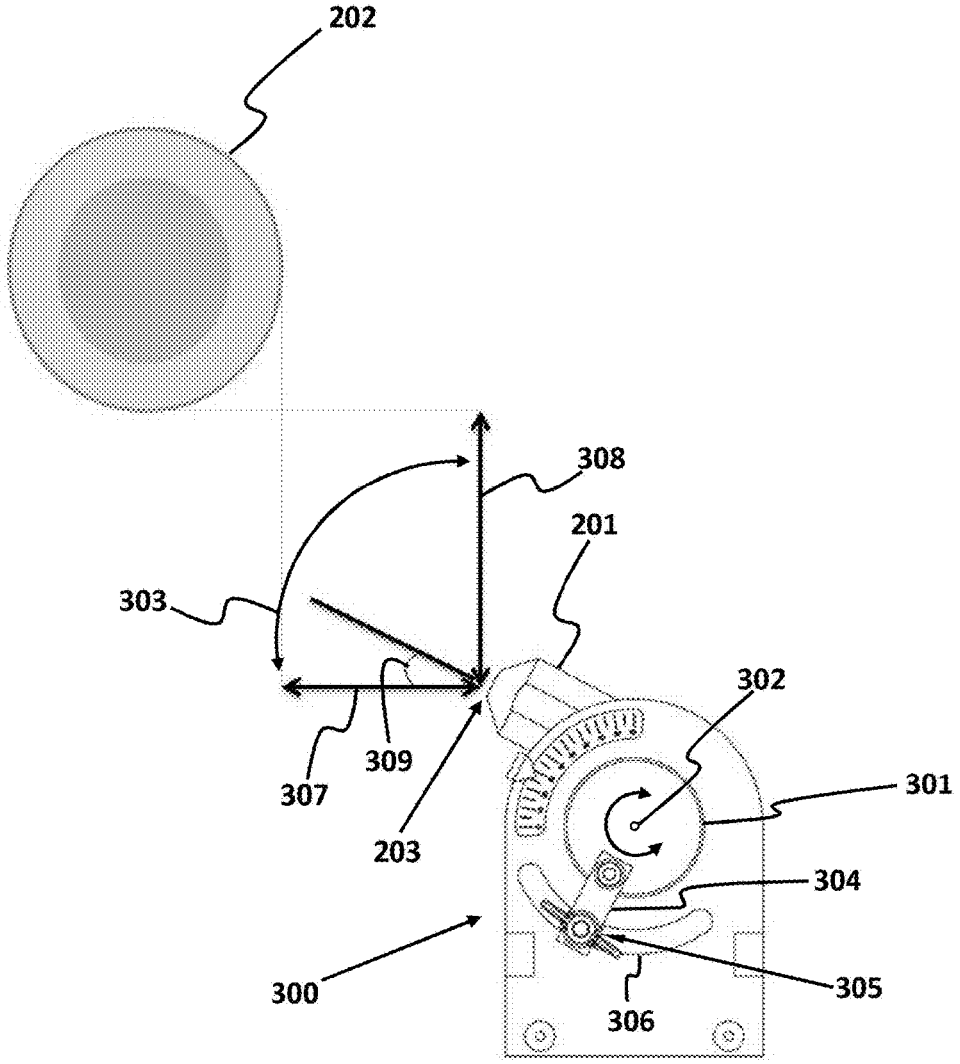
FIG. 3 illustrates a schematic representation of an implementation of a nozzle holder.

Referring now to FIG. 3, an implementation of a nozzle holder 300 that may be utilized in a blowing-assisted electrospinning system, such as the blowing-assisted electrospinning system 200, is illustrated. According to some implementations, the nozzle holder 300 may have at least two degrees of freedom. For example, the nozzle holder 300 can include a translational degree of freedom and a rotational degree of freedom. In other implementations, the nozzle holder 300 may be capable of additional degrees of freedom.

In some implementations, the nozzle 201 may be mounted on the nozzle holder 300. The nozzle holder 300 may be configured to facilitate the positioning of the nozzle 201 with respect to the collector 202. For purposes of this disclosure, positioning may include changing a distance of the nozzle 201 from the collector 202, and/or changing an angle at which the nozzle 201 is oriented toward the collector 202. In one implementation, the nozzle holder 300 is configured to allow the rotation of the nozzle 201 in one or more directions in order to arrange the nozzle 201 at various desired orientations with respect to the collector 202. Such arrangements can allow for the jetting of a discharged fluid from the nozzle tip 203 directly or indirectly toward the collector 202.

With further reference to FIG. 3, in one implementation, the nozzle holder 300 may include a mounting member 301. In some implementations, the mounting member 301 may include a substantially cylindrical three-dimensional shape on which the nozzle 201 is mounted or to which the nozzle 201 is attached. However, in other implementations, the mounting member 301 can include other elongated regular or irregular three-dimensional shapes. In addition, the mounting member 301 may be configured to rotate about a rotational axis 302. The rotation can change the orientation of the nozzle 201 with respect to the collector 202 to a rotational path such as the rotational path 303 with desirable angle 309 in FIG. 3. In some implementations, an angle adjustment mechanism may be utilized for rotating the mounting member 301 to a specific angle. The angle adjustment mechanism may include a link 304, where a proximal end of the link 304 is attached to the mounting member 301 and a distal end of the link 304 is attached to a sliding link 305 that slides inside a curved groove 306. In one implementation, moving the sliding link 305 inside the curved groove 306 may promote the rotation of the mounting member 301 about the axis 302 and thereby rotate the nozzle 201 along the rotational path 303 at various desired angles.

Furthermore, as noted above, the nozzle holder 300 may include at least one translational degree of freedom. The translational degree of freedom can allow for the adjustment of the nozzle holder 300 for example a horizontal distance 307 and/or a vertical distance 308 between the nozzle tip 203 and the collector 202 represented in FIG. 3. In one implementation, the horizontal distance 307 may be adjusted between approximately 10 and 70 mm and the vertical distance 308 may be adjusted between approximately 10 and 80 mm. In some implementations, the nozzle 201 may be oriented toward the collector 202 through use of the mounting member 301 to a desired angle 309 ranging between approximately 0 and 90°.

Figure 4:
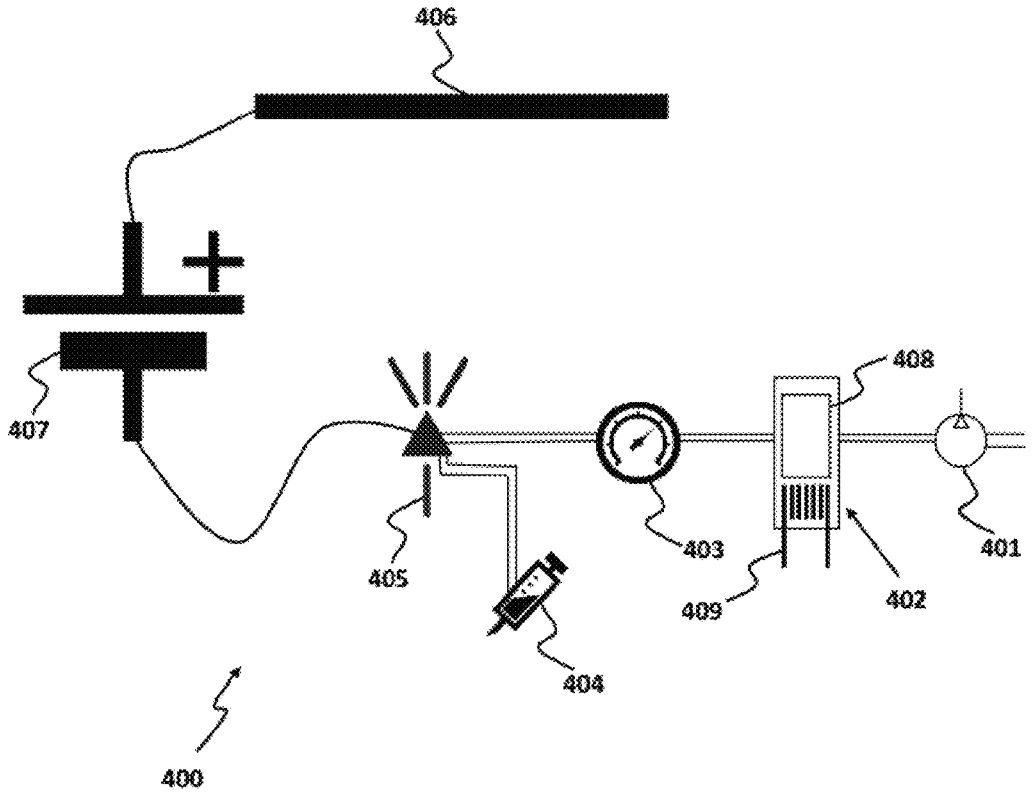
FIG. 4 illustrates a schematic representation of an implementation of an apparatus for blowing-assisted electrospinning.

In order to provide additional details to the reader, FIG. 4 shows a schematic representation of a blowing-assisted electrospinning system 400, according to one or more implementations of the present disclosure. In some implementations, the blowing-assisted electrospinning system 400 may be understood to include substantially similar features as the blowing-assisted electrospinning system 200 described with respect to FIG. 2, though in other implementations, some components or aspects may be omitted.

Referring to FIG. 4, in one implementation, the blowing-assisted electrospinning system 400 includes a compressed gas generating system 401, a solvent vapor generating system 402, a pressure adjustment system 403, and a solution injection system 404. Furthermore, in some implementations, the blowing-assisted electrospinning system 400 includes a nozzle 405 that may be substantially similar to the nozzle 201 of FIG. 2, a collector 406 that may be substantially similar to the collector 202 of FIG. 2, and/or a power supply 407 that may be substantially similar to the power supply 206 of FIG. 2.

In different implementations, the compressed gas generating system 401 may include, for example, a gas compression system that supplies a compressed gas stream with a predetermined pressure. In addition, in some implementations, the solvent vapor generating system 402 may include a storage tank 408 for preserving a solvent, and a heating element 409 for heating the solvent in order to generate a stream of the solvent vapor at a desired pressure and temperature. In one implementation, the compressed gas generating system 401 may be in fluid communication with the solvent vapor generating system 402 in order to mix the gas stream generated by the compressed gas generating system 401 and the stream of the solvent vapor that is generated by the solvent vapor generating system 402.

According to one implementation, the solvent vapor generating system 402 may further include a feedback system (not explicitly shown in FIG. 4) that may be configured for adjusting a ratio at which the stream of the solvent vapor and the gas stream are to be mixed in order to obtain a pressurized solvent/gas stream with a predetermined composition. As one example, the feedback system may be configured to manipulate or adjust the temperature of the heating element 409 of the solvent vapor generating system 402 in order to control the amount and the pressure of the stream of the solvent vapor that is to be mixed with the gas stream.

In some implementations, the pressure of the pressurized solvent/gas stream provided by the solvent vapor generating system 402 may then be further regulated by the pressure adjustment system 403 before the pressurized solvent/gas stream is injected by the nozzle 405.

With further reference to FIG. 4, in one implementation, the solution injection system 404 may be configured to inject a spinning solution through the nozzle 405. As an example, the solution injection system 404 can include a positive displacement pump. According to some implementations, the nozzle 405 may be substantially similar to the nozzle 201 of FIG. 2 and the nozzle 405 may similarly include an inner tube coaxially disposed with an outer tube. In such cases, the pressurized solvent/gas stream provided by the solvent vapor generating system 402 may be discharged from the outer tube of the nozzle 405 and the spinning solution provided by the solution injection system 404 may be discharged from the inner tube of the nozzle 405.

Figure 5:
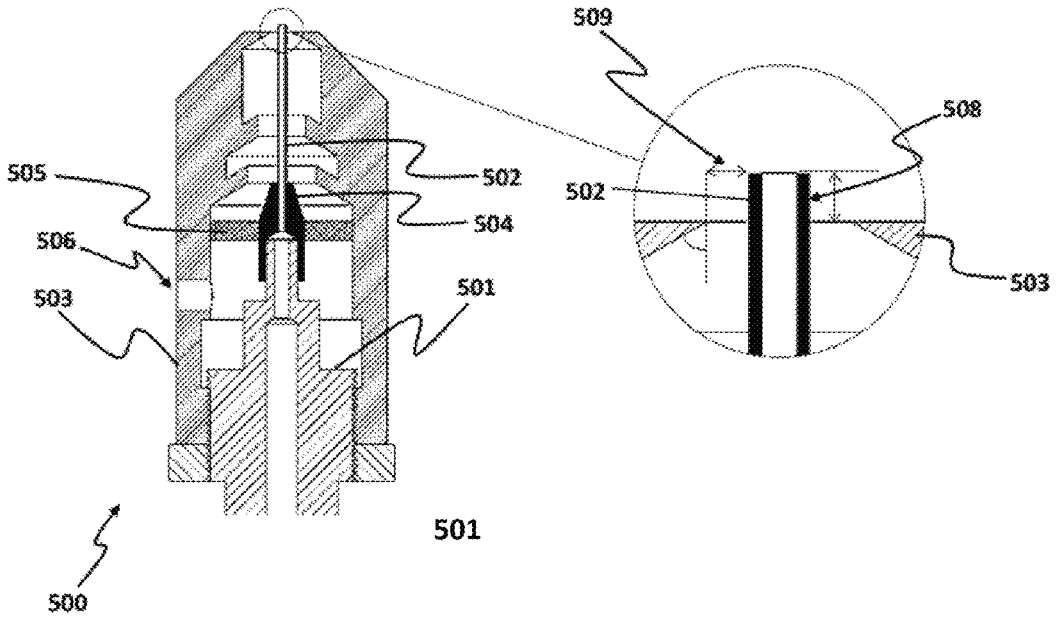
FIG. 5 illustrates an implementation of a nozzle holder system.

As illustrated in FIG. 5, in different implementations, a double-walled nozzle 500 may be used as an implementation of the nozzle 201 identified in FIG. 2. In FIG. 5 the nozzle holder can be understood to hold a plurality of nozzles, where each nozzle is connected to a respective solution injection unit.

In some implementations, the double-walled nozzle 500 may include an inner tube 502 that may function as a solution nozzle, and an outer tube 503 that may function as a solvent/gas nozzle. In one implementation, a needle retainer nut 504 may be used to retain the inner tube 502 and provide a sealing mechanism to help prevent solution leakage from the inner tube 502. In some implementations, a filter mat 505 may further be used to filter the solvent/gas stream that flows through the outer tube 503. In one implementation, the pressurized solvent/gas stream may enter the nozzle 500 from an opening 506 on the outer tube 503.

With further reference to FIG. 5, the double-walled nozzle 500 may further include one or more of the following features in some implementations. For example, in one implementation, the inner tube 502 may include an extended tip 508 that may extend from a tip of the outer tube 503 at a distance in the range of −10 to 10 mm. In one implementation, the extended tip 508 extends distally outward from the top of the outer tube 503. Furthermore, in one implementation, the double-walled nozzle 500 may be disposed inside the outer tube 503 with an air gap 509 that may be preferably in a range of 0.1 to 10 mm, though in other implementations the air gap can be larger or smaller in size. The air gap 509 defines a discharge surface for the pressurized solvent/gas stream. Benefits of extending the inner tube 502 from the tip of the outer tube 503 include but are not limited to allowing the solvent vapor in the pressurized solvent/gas stream to contact the tip of the inner tube 502, thereby dissolving and wiping out possible polymer fouling that may block the inner tube 502.

Figure 6:
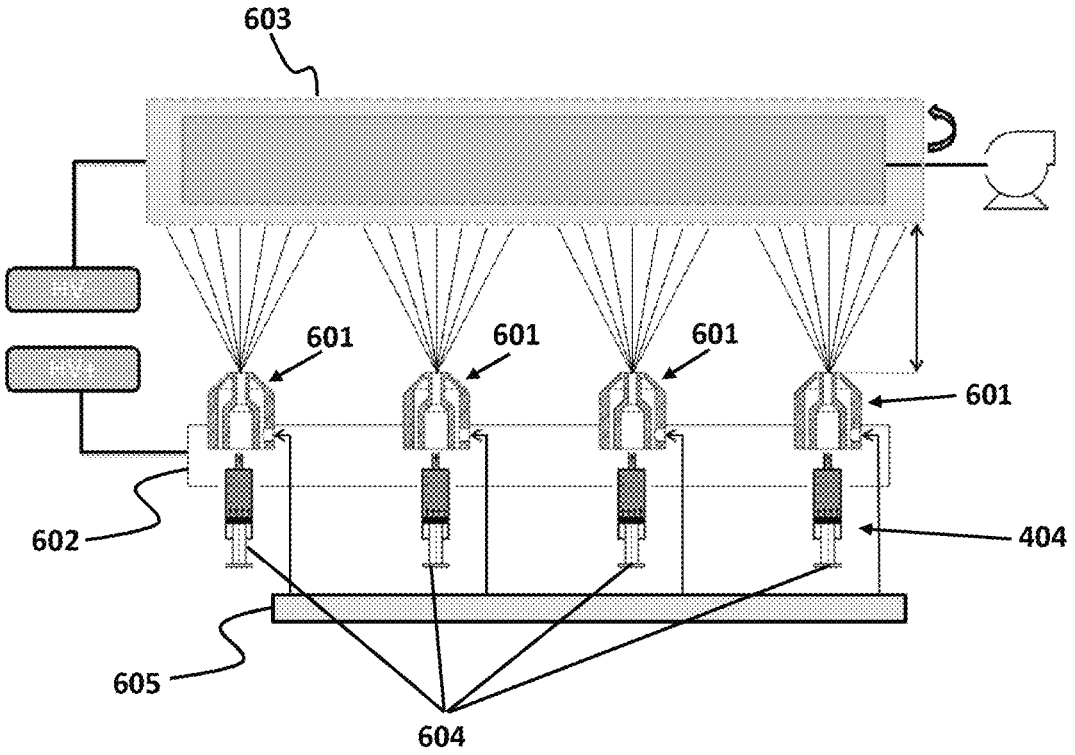
FIG. 6 illustrates a front cross-sectional view of an implementation of a double-walled nozzle.

FIG. 6 illustrates an implementation of a blowing-assisted electrospinning system with a plurality of double-walled nozzles 601 mounted on a nozzle holder 602. In one implementation, each double-walled nozzle in the plurality of double-walled nozzles 601 may be substantially similar to the nozzle 201. According to one implementation, the nozzle holder 602 may have a substantially similar structure as the nozzle holder 300 of FIG. 3. However, in some implementations, the mounting member 301 may be elongated lengthwise in this structure to allow for the mounting of the plurality of double-walled nozzles 601 along a length of the mounting member 301.

Furthermore, in some implementations, the degrees of freedom of the nozzle holder 602 may also be substantially similar to that described of the nozzle holder 300 of FIG. 3. In other words, in one implementation, the nozzle holder 602 allows for the positioning of the plurality of double-walled nozzles 601 with respect to a collector 603 that may be substantially similar to the collector 202 of FIG. 2. Mounting the plurality of double-walled nozzles 601 on the nozzle holder 602 can promote increased throughput by using one single blowing-assisted electrospinning system.

Referring to both FIGS. 4 and 6, in one implementation, the plurality of double-walled nozzles 601 may be in fluid communication with a solution injection system, such as the solution injection system 404. This can facilitate the introduction of a spinning solution into the nozzles. The spinning solution can include substantially equal pressures and velocities in some implementations. As an example, the solution injection system 404 may include a plurality of positive displacement pumps 604 that may each be individually in fluid communication with respective double-walled nozzles 601. This feature allows an operator to have substantially total control of pressure and velocity of the discharged solution for each nozzle in the plurality of double-walled nozzles 601.

In some implementations, pressurized solvent vapor/gas stream may be fed separately through each of the plurality of double-walled nozzles 601. According to another implementation, pressurized solvent vapor/gas stream may be sent to a manifold 605 and then be distributed among the plurality of the double-walled nozzles 601.

Example 1

In the following example, in order to fabricate nanofibrous articles from a polymer solution, the method 100 of FIG. 1 was implemented by the blowing-assisted electrospinning system 400 of FIG. 4. With respect to the first step 101 of method 100, a polymer solution of polyacrylonitrile (PAN) in dimethylformamide (DMF) with a concentration of approximately 12% (w/v) and a mixture of DMF vapor and pressurized air were produced. In order to accomplish the second step 102 of method 100, a nozzle such as double-walled nozzle 500 of FIG. 5 was utilized.

Referring to FIG. 5, the double-walled nozzle 500 that was used in this example had an inner tube such as inner tube 502 and an outer tube such as outer tube 503. The inner tube that was selected as the solution nozzle for this example had approximately a 1 mm inner diameter and extended from a tip of the outer tube of nozzle a distance of approximately 3 mm. In addition, there was an air gap of about 3 mm between the outer tube and the inner tube, forming an air gap (similar to the air gap 509). In addition, a collector such as collector 202 (see FIG. 3) was provided and positioned in front of the nozzle 201. The horizontal distance 307 and the vertical distance 308 were both set to approximately 50 cm and the angle 309 was set to approximately 60 degrees.

Referring to FIG. 4, in order to accomplish the subsequent third step 103 of method 100, a power supply such as power supply 407 of FIG. 4 was used to provide an electrostatic field between the nozzle 405 and the collector 406. A positive electrode of the power supply 407 that provided a voltage of approximately +40 kV was connected to the nozzle 405 and a negative electrode of the power supply 407 that provided a voltage of approximately −40 kV was connected to the collector 406. In addition, in order to accomplish the fourth step 104 of method 100, a polymer solution, described with respect to the first step 101 of method 100, was pumped to the nozzle 502 in such a way whereby the solution jetted out at a rate of approximately 80 ml/hour. Concurrently, the mixture of vapor and pressurized air that was provided according to the first step 101 of method 100 was pumped to the outer tube 503 at a pressure of approximately 400 mbar.

Figure 7A:
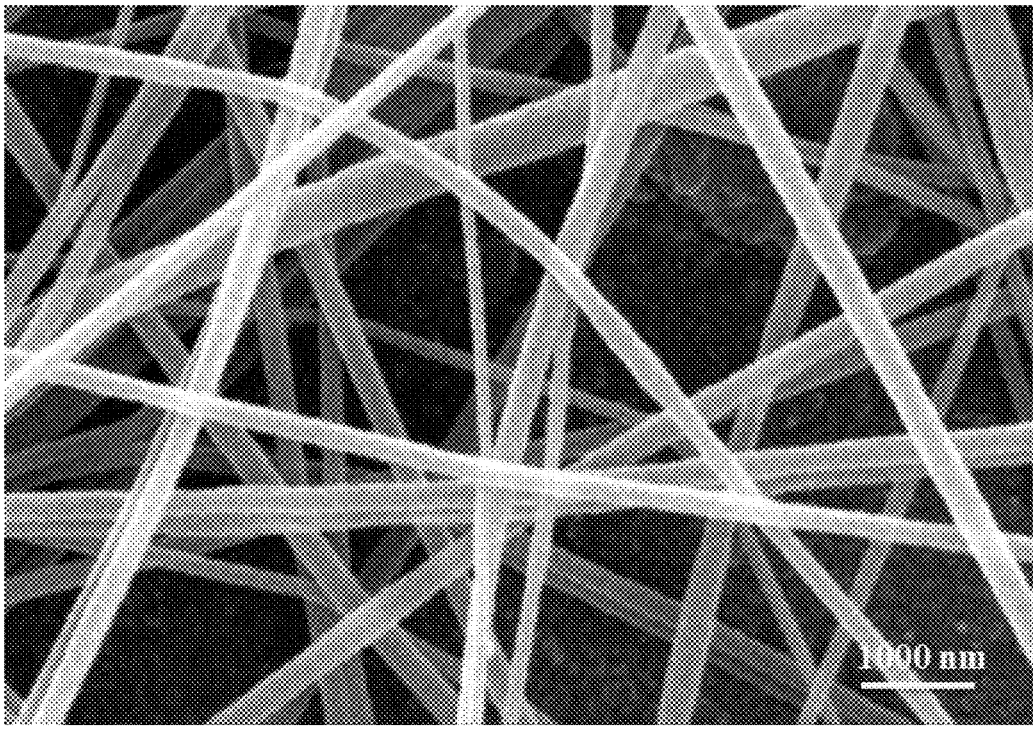
FIG. 7A is a scanning electron microscope (SEM) image of nanofibrous articles that are fabricated by an implementation of the blowing-assisted electrospinning process.

FIG. 7A shows a scanning electron microscope (SEM) image of nanofibrous articles that were fabricated by the blowing-assisted electrospinning process as described above in EXAMPLE 1.

Example 2

In the following example, in order to fabricate nanofibrous articles from a polymer solution, the method 100 of FIG. 1 was implemented by use of the blowing-assisted electrospinning system 400 of FIG. 4. A polymer solution of polyamide 6,6 in formic acid with a concentration of approximately 12% and a mixture of formic acid vapor and pressurized air was provided, per first step 101 of method 100. In order to accomplish the second step 102 of method 100, a nozzle such as double-walled nozzle 500 of FIG. 5 was utilized.

Referring again to FIG. 5, the double-walled nozzle 500 that was used in this example had an inner tube such as inner tube 502 and an outer tube such as outer tube 503. The inner tube that was selected as the solution nozzle for this example has an approximately 1 mm inner diameter and extended from a tip of the outer tube of nozzle a distance of approximately 3 mm. In addition, there was an air gap of about 3 mm between the outer tube and the inner tube (see air gap 509).

Referring next to FIG. 3, a collector such as collector 202 was provided and positioned in front of nozzle 201. The horizontal distance 307 and the vertical distance 308 were both set to approximately 50 cm and the angle 309 was set to approximately 60 degrees.

In order to accomplish the third step 103 of method 100, a power supply such as the power supply 407 of FIG. 4 was used to provide an electrostatic field between the nozzle 405 and the collector 406. A positive electrode of the power supply 407 that provided a voltage of approximately +40 kV was connected to the nozzle 405 and a negative electrode of the power supply 407 that provided a voltage of approximately −40 kV was connected to the collector 406. With respect to the fourth step 104 of method 100, the polymer solution that was provided in the first step 101 of method 100 was pumped to the nozzle 502 such that the solution jetted out at a rate of approximately 80 ml/hour. Concurrently, the mixture of vapor and pressurized air that was provided according to the first step 101 of method 100 was pumped to the outer tube 503 at a pressure of approximately 400 mbar.

Figure 7B:
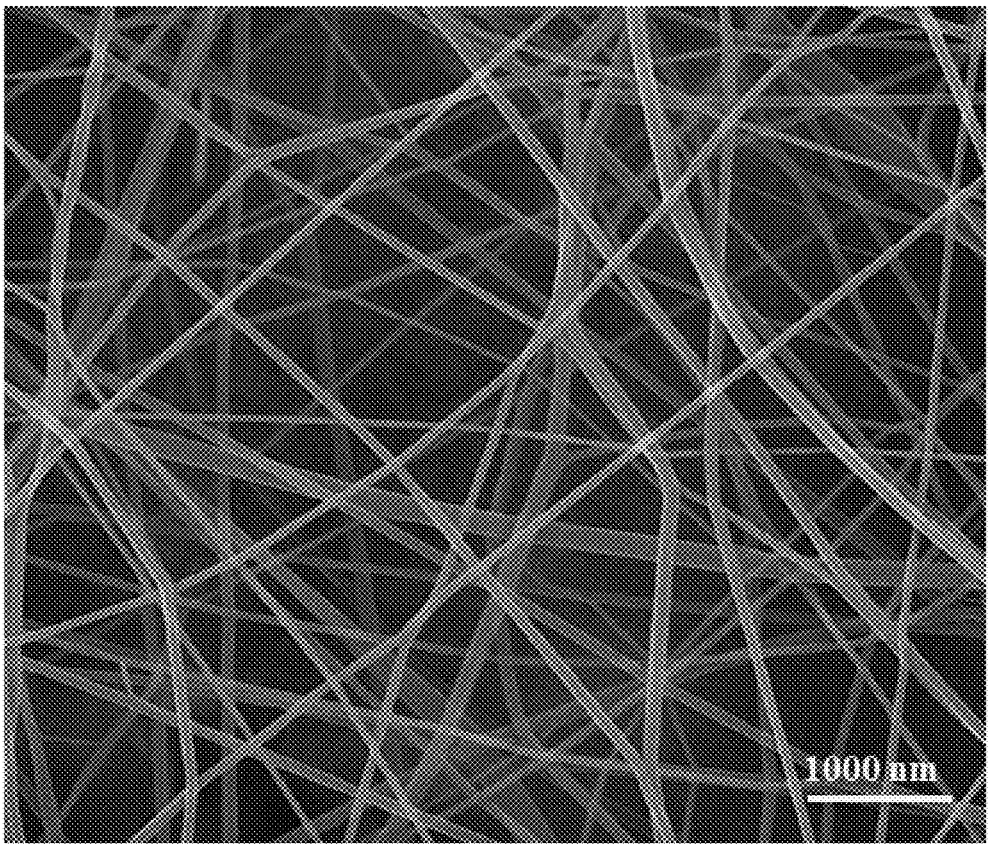
FIG. 7B is a scanning electron microscope (SEM) image of nanofibrous articles that are fabricated by an implementation of the blowing-assisted electrospinning process.

FIG. 7B shows a scanning electron microscope (SEM) image of nanofibrous articles that are fabricated by the blowing-assisted electrospinning process as described above in EXAMPLE 2.

Example 3

In the following example, in order to fabricate nanofibrous articles from a polymer solution, the method 100 of FIG. 1 was implemented by the blowing-assisted electrospinning system 400 described above with respect to FIG. 4. As per the first step 101 of method 100, a polymer solution of polyvinyl alcohol (PVA) in dimethylformamide (DMF) solvent with a concentration of approximately 10% (w/v) and a mixture of DMF vapor and pressurized air were provided. In order to accomplish the second step 102 of method 100, a nozzle such as the double-walled nozzle 500 of FIG. 5 was utilized.

Referring to FIG. 5, the double-walled nozzle 500 that was used in this example had an inner tube such as inner tube 502 and an outer tube such as outer tube 503. The inner tube that was selected as the solution nozzle for this example had a 1 mm inner diameter and extended from a tip of the outer tube of nozzle a distance of approximately 3 mm. In addition, there was an air gap of about 3 mm between the outer tube and the inner tube (such as the air gap 509 in FIG. 5). Referring next to FIG. 3, a collector such as collector 202 was provided and positioned in front of nozzle 201. The horizontal distance 307 and the vertical distance 308 were both set to approximately 50 cm and the angle 309 was set to approximately 60 degrees.

With respect to the subsequent third step 103 of method 100, a power supply such as the power supply 407 of FIG. 4 was used to provide an electrostatic field between the nozzle 405 and the collector 406. A positive electrode of the power supply 407 that provided a voltage of approximately +40 kV was connected to nozzle 405 and a negative electrode of the power supply 407 that provided a voltage of approximately −40 kV was connected to the collector 406. In addition, in order to accomplish the fourth step 104 of method 100, the polymer solution that was provided in the first step 101 of method 100 was pumped to the nozzle 502 such that the solution jetted out at a rate of approximately 80 ml/hour. Concurrently, the mixture of vapor and pressurized air that was provided according to the first step 101 of method 100 was pumped to the outer tube 503 with a pressure of approximately 400 mbar.

Figure 7C:
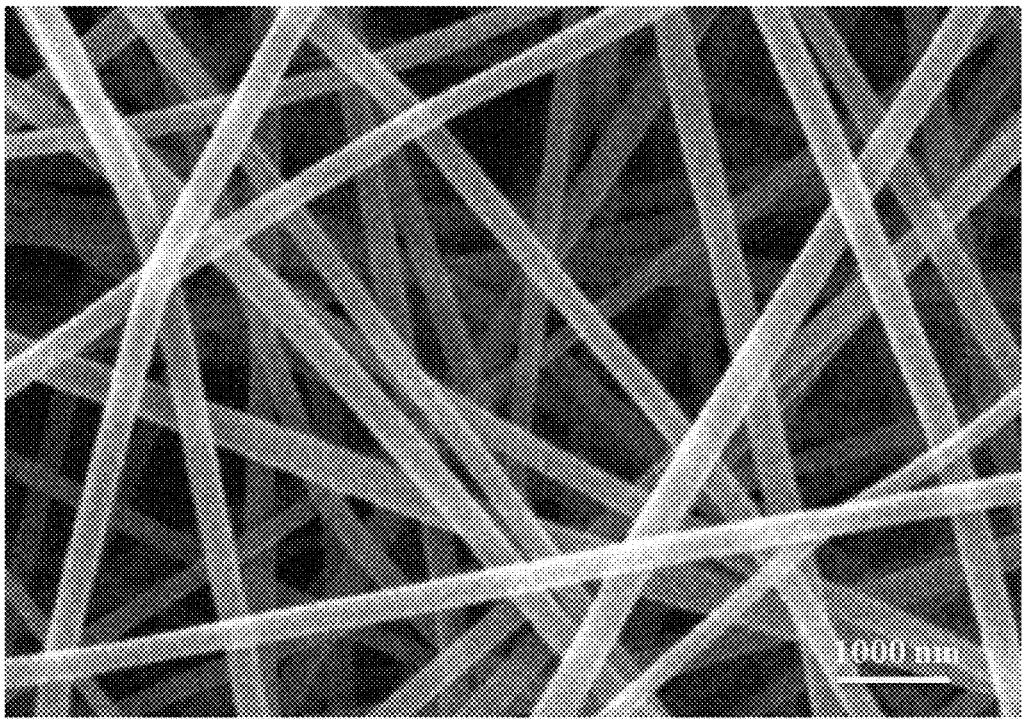
FIG. 7C is a scanning electron microscope (SEM) image of nanofibrous articles that are fabricated by an implementation of the blowing-assisted electrospinning process.

FIG. 7C shows a scanning electron microscope (SEM) image of nanofibrous articles that were fabricated by the blowing-assisted electrospinning process as described above in EXAMPLE 3.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A method for fabricating nanofibrous articles, the method comprising:

preparing a spinning solution by dissolving a polymer in a solvent;

mixing a vapor stream of the solvent with a stream of a pressurized gas at a predetermined ratio to obtain a pressurized solvent/gas stream;

feeding the spinning solution through an inner tube of a double-walled nozzle;

concurrently feeding the pressurized solvent/gas stream through an outer tube of the double-walled nozzle, wherein the inner tube is disposed coaxially within the outer tube;

applying an electrical field between a tip of the double-walled nozzle and a collector, wherein the double-walled nozzle is secured under the collector;

adjusting orientation of the double-walled nozzle with respect to the collector by rotating the double-walled nozzle along a rotational path ranging between 0° and 90°;

discharging the spinning solution and the pressurized solvent/gas stream concurrently from the double-walled nozzle; and producing nanofibrous articles on the collector.

2. The method of claim 1, wherein the inner tube of the double-walled nozzle extends from a tip of the outer tube of the double-walled nozzle by a distance in the range of −10 to 10 mm.

3. The method of claim 1, wherein there is an air gap with a width ranging between 0.1 to 10 mm between the outer tube and the inner tube.

4. The method of claim 1, wherein the electrical field includes a potential difference ranging between 10 and 100 kV.

5. The method of claim 1, wherein the polymer is selected from the group consisting of polyimide, Polyamide 6 and 6,6, hyaluronic acid (HA), polyaramide, polyacrylonitrile (PAN), polyethylene terephthalate (PET), polyaniline (PANI), polyethylene oxide(PEO), styrene butadiene rubber (SBR), polystyrene (PS), polyvinyl chloride (PVC), polyvinyl alcohol (PVA), polyvinylidene fluoride (PVDF), poly (lactic acid) (PLA), polyurethanes(PU), polysiloxanes or silicones, polyvinyl pyrrolidone (PVP), polycaprolactones, poly(methyl methacrylate) (PMMA), polyacrylamide (PAM), polyglycolides (PGA), poly(lactide-co-glycolides) (PLGA), polylactides, poly(acrylic acid), polybutene, polysulfide, cyclic polyolefins, and combinations thereof.

6. The method of claim 1, wherein the solvent is selected from the group consisting of formic acid, N-dimethylformamide (DMF), water, chloroform, Dimethylacetamide (DMAc), Ethanol, Tetrahydrofuran(THF), Acetone, 2-Propanol, acetic acid, and combinations thereof.

7. The method of claim 1, wherein the polymer has a concentration ranging between 5% w/v and 40% w/v in the solvent.

8. The method of claim 1, wherein the stream of mixed solvent vapor and pressurized gas has a pressure ranging between 100 and 2000 mbar.

9. The method of claim 1, wherein the spinning solution is discharged from the double-walled nozzle at a rate between 10 ml/hour and 100 ml/hour.

10. The method of claim 1, further comprising rotating the nozzle such that the nozzle is oriented toward the collector.

11. The method according to claim 1, wherein adjusting orientation of the double-walled nozzle with respect to the collector includes mounting the double-walled nozzle on a nozzle holder, the nozzle holder configured to permit rotation of the double-walled nozzle with respect to the collector.

* * * * *